US006003843A

United States Patent [19]

Fujiwara et al.

[11] Patent Number: 6,003,843

[45] Date of Patent: Dec. 21, 1999

[54] BELT HOIST

[75] Inventors: Hidenori Fujiwara; Masaru Fujikawa; Koji Saai, all of Osaka, Japan

[73] Assignee: Elephant Chain Block Co., Ltd., Osaka, Japan

[21] Appl. No.: 08/891,983

[22] Filed: Jul. 11, 1997

[30] Foreign Application Priority Data

Jul. 31, 1996 [JP] Japan ..... 8-202497
Jul. 31, 1996 [JP] Japan ..... 8-202498

[51] Int. Cl.[6] ..... B66D 1/48

[52] U.S. Cl. ..... 254/271; 254/272; 254/335

[58] Field of Search ..... 254/271, 272, 254/273, 323, 335

[56] References Cited

U.S. PATENT DOCUMENTS

| | | | |
|---|---|---|---|
| 2,335,568 | 11/1943 | Lock | 254/335 |
| 3,005,622 | 10/1961 | Garnier . | |
| 3,158,355 | 11/1964 | Wilson | 254/271 |
| 3,215,375 | 11/1965 | Radovitz | 254/271 |
| 3,994,476 | 11/1976 | Van Gennep | 254/272 |
| 4,213,019 | 7/1980 | Houp | 254/271 |
| 4,491,301 | 1/1985 | Pendola | 254/273 |
| 4,535,973 | 8/1985 | Dorr et al. | 254/323 |
| 5,295,664 | 3/1994 | Kamper | 254/273 |

FOREIGN PATENT DOCUMENTS

| | | |
|---|---|---|
| 0 082 046 | 6/1983 | European Pat. Off. . |
| 2 350 295 | 12/1977 | France . |
| 1074836 | 2/1960 | Germany . |
| 23 65 374 | 1/1975 | Germany . |
| 5-32386 | 4/1993 | Japan . |
| 6-25290 | 5/1994 | Japan . |
| 1106253 | 3/1968 | United Kingdom . |

*Primary Examiner*—Katherine A. Matecki
*Attorney, Agent, or Firm*—Dickstein Shapiro Morin & Oshinsky LLP

[57] ABSTRACT

To prevent a random coil of and an overwind of a belt with simple structure, a belt hoist includes a random coil preventing member pressed against the belt wound around a winding member to prevent a random coil of the belt, the random coil preventing member being movable in response to changes in diameter of the belt; and control means for controlling drive of drive means in association with the random coil preventing member when the diameter becomes a specified diameter. Further, a belt guide having a belt guide portion is supported between two side plates in such a freely sliding manner as to allow the winding of the belt onto the winding member.

7 Claims, 7 Drawing Sheets

BELT HOIST

BACKGROUND OF THE INVENTION

1. Field of the Invention

The present invention relates to a belt hoist wherein a winding member for winding a belt thereon is rotationally supported between a pair of opposing side plates.

2. Description of the Prior Art

Belt hoists of this kind are known as disclosed by Japanese Laid-Open Utility Model Publications No. Hei 6(1994)-25290 and No. Hei 5(1993)-32386, for example. The belt hoists disclosed by these publications are so structured that a flat belt retaining a hook or equivalent at its front end portion is wound around the winding member rotationally driven by a normal and reverse rotation motor. The belt is taken up on or paid out from the winding member to hoist up and down or drag a load through the belt.

Further, the belt hoist disclosed by the Japanese Laid-Open Utility Model Publications No. Hei 5(1993)-32386 is so structured that parts to be detected are fitted to the belt at several points along a lengthwise direction thereof and an overwinding detecting sensor and an over-lowering detecting sensor are retained to a fixed member of the hoist with spacing from the belt at a specified interval to be opposite to the parts to be detected at the time of the overwinding and over-lowering of the belt. When the respective sensors are opposite to the related parts to be detected, rotation of the motor is stopped according to the output from the sensors to prevent the overwinding of the belt.

This constructed belt hoist of conventional type has the advantage that various kinds of components of the hoist can be prevented from breakage resulting from the overwinding of the belt at the time of hoisting up and down or dragging a load through the belt, but it has disadvantages that parts count increases and thus structure is complicated, due to the structure that the parts to be detected are provided at several points of the belt and the sensors are provided at the fixed member. In addition, since this conventional type belt hoist has no means for preventing the belt from being taken up with twisted, the belt may sometimes be coiled randomly.

SUMMARY OF THE INVENTION

Accordingly, the object of the present invention is to provide a belt hoist which enables the belt to be prevented from taken up in a twisted state and from being overwound, with simple structure.

This invention is directed to a belt hoist which comprises a winding member around which a belt is wound; drive means for driving the winding member; a random coil preventing member pressed against the belt wound around the winding member to prevent a random coil of the belt, the random coil preventing member being movable in response to changes in diameter of the belt; and control means for controlling drive of the drive means in association with the random coil preventing member when the diameter of the wound belt becomes a specified diameter.

According to this invention, when the belt wound around the winding member is wound or unwound by the winding member being rotationally driven by the drive means at the time of raising or lowering or dragging a heavy load with the hoist, the belt is kept on being pressed against the winding member by the random coil preventing member which is movable in response to changes in diameter of the belt resulting from the raising or lowering of the load. Thus, the random coil preventing member is always pressed against the belt so that the belt can be wound on the winding member in a proper posture at all times without being twisted, thus preventing the random coil of the belt against the winding member.

Further, the drive of the drive means is controlled via the control means associated with the random coil preventing member movable in response to changes in diameter of the wound belt on the winding member. The drive means is kept on driving to wind and unwind the belt until the diameter of the belt becomes a specified diameter and is stopped when the diameter of the wound belt reaches the specified diameter, by the control of the control means associated with the random coil preventing means. Thus, the overwinding of the belt and the resulting breakage of the components of the hoist can be prevented.

Besides, the prevention of the overwinding of the belt is effected through the use of the random coil preventing member which is associated with the control means for controlling the drive of the driving means. This can provide the advantages that the prevention of the random coil and overwinding of the belt can be achieved with reduced parts count and simplified structure, and the hoist can be manufactured at reduced costs as a whole.

Further, it is preferable in this case that the random coil preventing member is so supported to the winding member as to be swingable outwardly with respect to a radial direction of the winding member and is always biased toward an outer periphery of the winding member by a biasing spring.

With this construction in which the random coil preventing member is so supported as to freely swing and also is biased to the outer periphery of the winding member by the biasing spring, although the circle diameter of the belt changes in response to the winding or unwinding of the belt wound around the winding member, variations in the biasing force acting to the belt can be minimized to effectively prevent the belt from being twisted no matter what circle diameter of the belt is. Also, the random coil preventing member can be surely swung in response to changes in circle diameter of the belt to accurately control the drive of the drive means with the aid of the random coil preventing member.

Desirably, the belt hoist further comprises (i) protrusions provided at an axial end portion of a pivot shaft on which the random coil preventing member is pivotally supported and (ii) detection switches capable of operation by contact with the protrusions when the diameter of the belt wound around the winding member reaches a specified diameter.

The protrusions and detection switches serving as the control means are provided at the axial end portion of the pivot shaft of the random coil preventing member, and the protrusions are brought into contact with the switches via which the drive of the driving means is controlled when the diameter of the belt reaches a specified diameter. This arrangement can provide the advantage in that the protrusions and the switches can be located at an outside of a support member supporting the random coil preventing member so that maintenance of the detection switches can be easily performed without affecting the random coil preventing member and the winding and unwinding of the belt. Besides, the use of these protrusions and detection switches enables the control means to be simplified in structure and also enables the drive of the drive means to be surely controlled by the control means.

Further, this invention is also directed to a belt hoist including a belt guide having a belt guide portion which is arranged between two spaced apart opposing side plates in such a freely sliding manner as to allow the winding of the belt around the winding member.

According to this invention, since the belt is guided by the belt guide portion of the belt guide when taken up or paid out from the winding member, the belt can be prevented from being wound in a randomly coiled state or particularly can be wound onto the winding member in a good posture at all times, thus preventing possible breakage resulting from the random coil of the belt.

Besides, since the belt guide, which is supported in such a slidable manner as to allow the winding of the belt around the winding member, is slid relative to the side plates in response to changes in circle diameter of the belt wound around the winding member, the belt guided by the belt guide can be smoothly wound on or unwound from the winding member while twist in the belt can be surely prevented by the belt guide.

Preferably, the belt hoist includes a belt slack sensor for detecting slackness in a part of the belt to be guided which is arranged on a moving path along which the part of the belt to be guided into the belt guide portion moves.

With this construction including the belt slack sensor, the belt slack sensor works when the belt paid out loses its tension, due to a hook at the free end of the belt being in contact with the ground or being caught on an obstacle in the course of the unwinding of the belt or any other reason, and rotation of the winding member can be stopped immediately in accordance with the detected result of the belt slack sensor. Thus, the random coil of the belt resulting from the winding member being rotated in the state that the belt being paid out has lost in its tension can be prevented. Further, a reverse winding of the belt resulting from the winding member being kept on rotating even after the wound belt is paid out entirely can also be prevented.

Further, it is advantageous that one of the belt guide and the side plates is provided with engaging projections and the other of the belt guide and the side plates is provided with guide slits engageable with the engaging projections and extending at least from an inner position at which the belt of a minimum diameter hangs down to an outer position at which the belt of a maximum diameter hangs down.

This construction including the engaging projections and the guide slits allows the belt guide to slide well in a standard range from the inner position to the outer position in response to changes in the diameter of the belt on the winding member. This provides the result that whenever wound or unwound, the belt is put into place to be vertically hung down from the winding member, and thereby the belt guide can be effectively escaped from load applied from a hanging heavy load. This enables the durability of the belt guide to be enhanced increasingly and also enables frictional resistance between the belt guide and the belt to be reduced increasingly, thus providing the advantage that the winding and unwinding of the belt onto and from the winding member can be more smoothly performed. Further, in a case where the guide slit is adapted to have a length somewhat larger than the above said standard range, that could provide the result that when the belt is slanted in front or in behind with respect to the side plates by a heavy load dragged, the slope of the belt at the belt guide can be made gentle by the belt guide moving along the guide slit to an extent beyond the standard range. This can provide the advantage that a dragging work by use of the belt can be well done, while twist in the belt is being prevented.

Further, it is preferable in this case that the engaging projections are shaped into a non-circular form so that the belt guide is non-rotatable relative to the side plates.

This allows the belt guide to be slid without being rotated relative to the side plates. By virtue of this, a possible accident that the belt guide may be rotated to cause the belt to bulge between the belt guide and the winding member when the belt is paid out in a nearly unloaded state in an unwinding direction by a driving force applied from the winding member side can be prevented from happening, to ensure a smoothly paying out of the belt.

BRIEF DESCRIPTION OF THE DRAWINGS

The invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiment.

Figure 8:
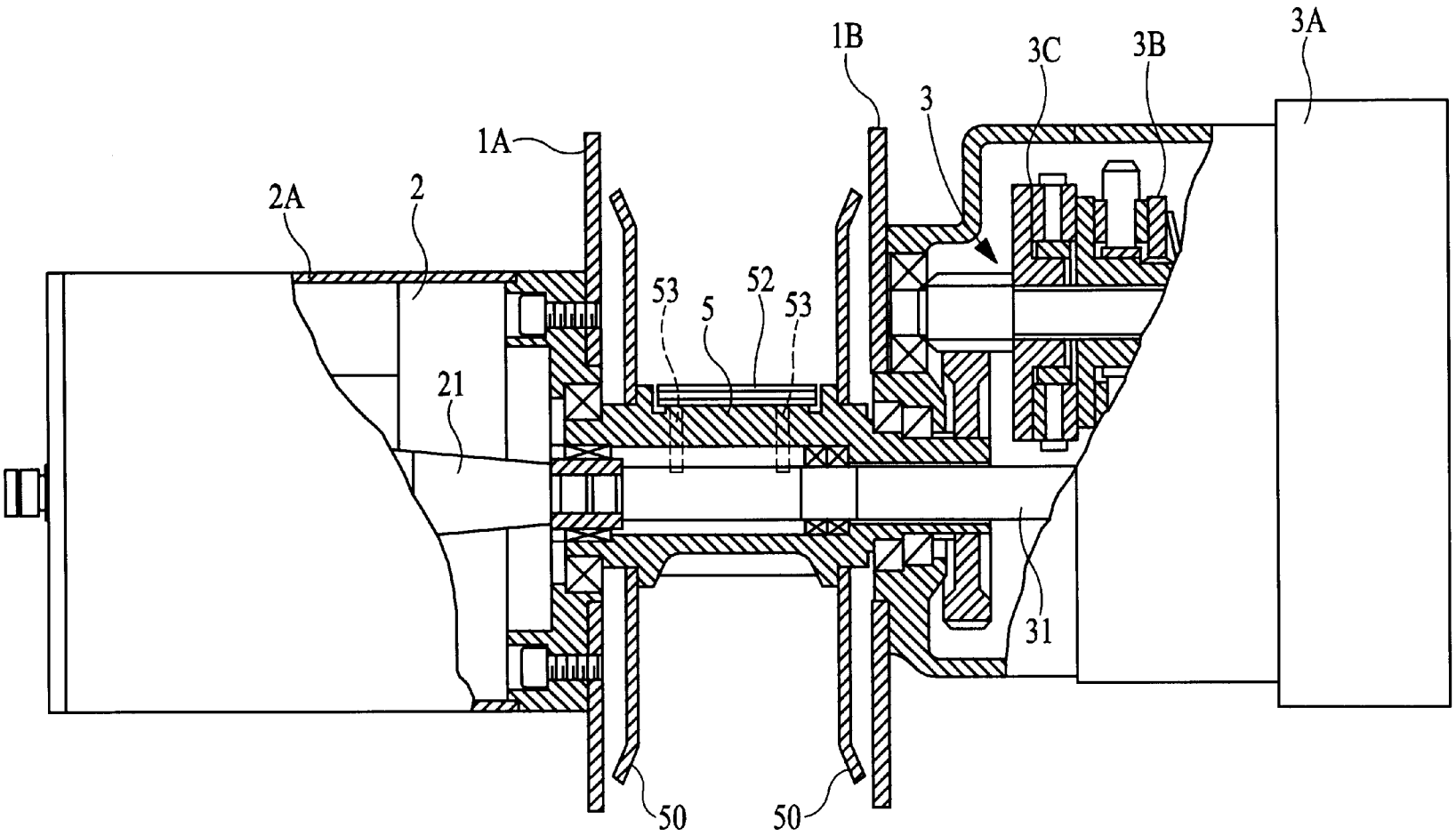
FIG. 8 is a partly omitted plan view of the belt hoist.
Figure 9:
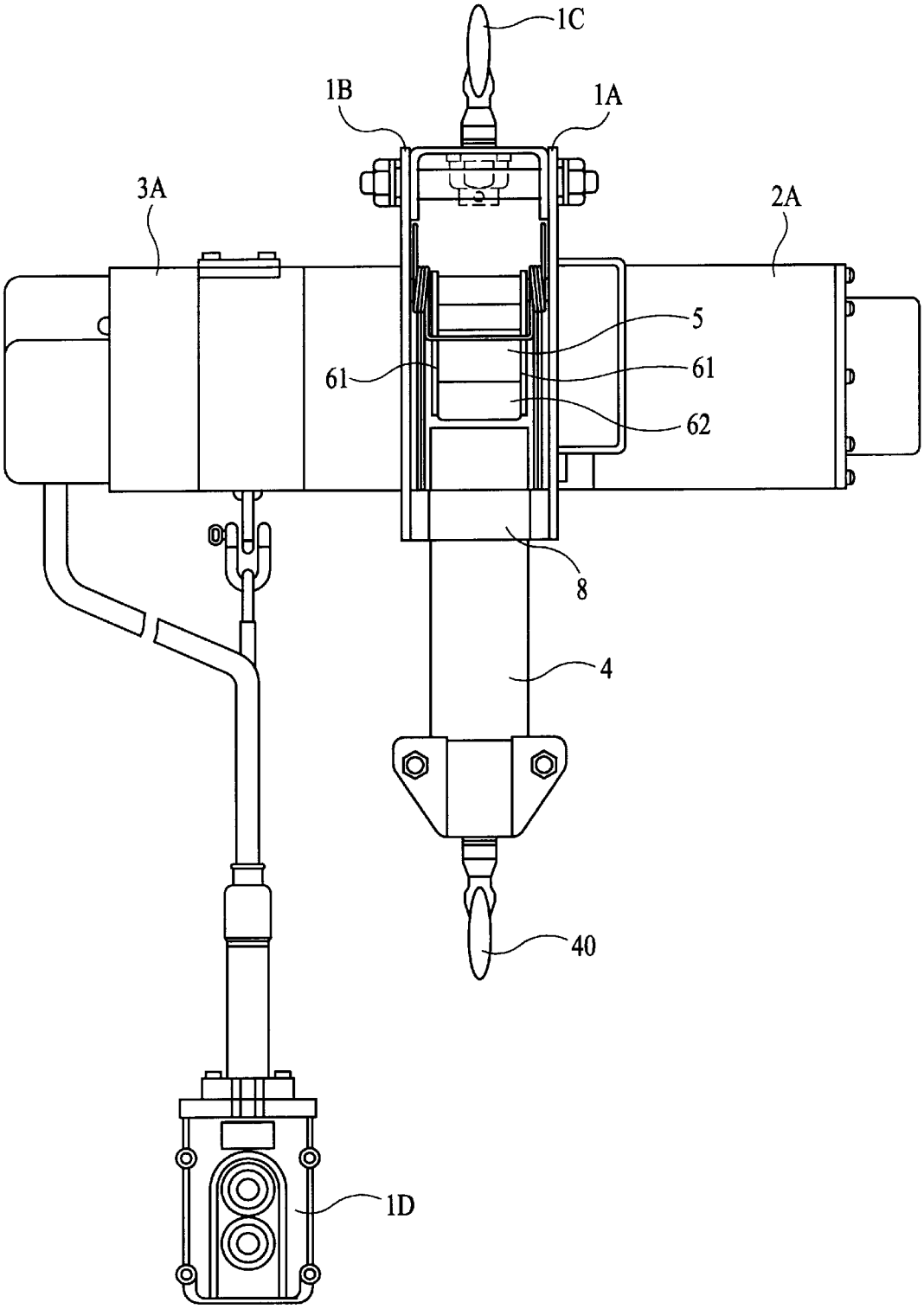
FIG. 9 is a rear view of the entire structure of the belt hoist.

A belt hoist shown in FIGS. 8 and 9 is provided with a pair of spaced apart, opposite first and second side plates 1A, 1B; a normal and reverse rotation motor 2 serving as drive means, arranged at an outside of the first side plate 1A and covered with a cover 2A; and a reduction gear mechanism 3 including an over-loading prevent mechanism 3B and a mechanical brake 3C, arranged at an outside of the second side plate 1B and covered with a cover 3A.

Further, a cylindrical winding member 5, around which a flat belt 4 fitting a hook 40 at the utmost end portion thereof is wound and which is associated with the reduction gear mechanism 3, is rotatably supported via bearing means between the side plates 1A, 1B. In the inside of the winding member 5, a drive shaft 31 having a first gear of the reduction gear mechanism 3 is rotatably supported via bearings. The drive shaft 31 is connected with a motor shaft 21 extending from the motor 2 at one end thereof so as to be associated in operation therewith so that the winding member 5 can be rotated by drive of the motor 2 in the normal direction or in the reverse direction through the motor shaft 21, the drive shaft 31 and the reduction gear mechanism 3.

The winding member 5 is rotated in the normal direction by the motor 2 to wind the belt 4 around the winding member 5 so as to hoist up a heavy load through the belt 4 or is rotated in the reverse direction to pay out the belt 4 from the winding member 5 so as to hoist down the heavy load through the belt 4.

In the illustrated embodiment, a pair of disc-like flanges 50, 50 are fitted to the winding member 5 at the both lengthwise ends thereof, and the belt 4 is wound onto the periphery of the winding member 5 between the pair of flanges 50. Further, as shown in FIG. 9, a retaining fixture 1C of a hook is fixed between the side plates 1A, 1B at the top portion thereof, and a control unit 1D for controlling the winding member 5 to rotate in the normal direction or in the reverse direction is connected with the cover 3A.

Figure 1:
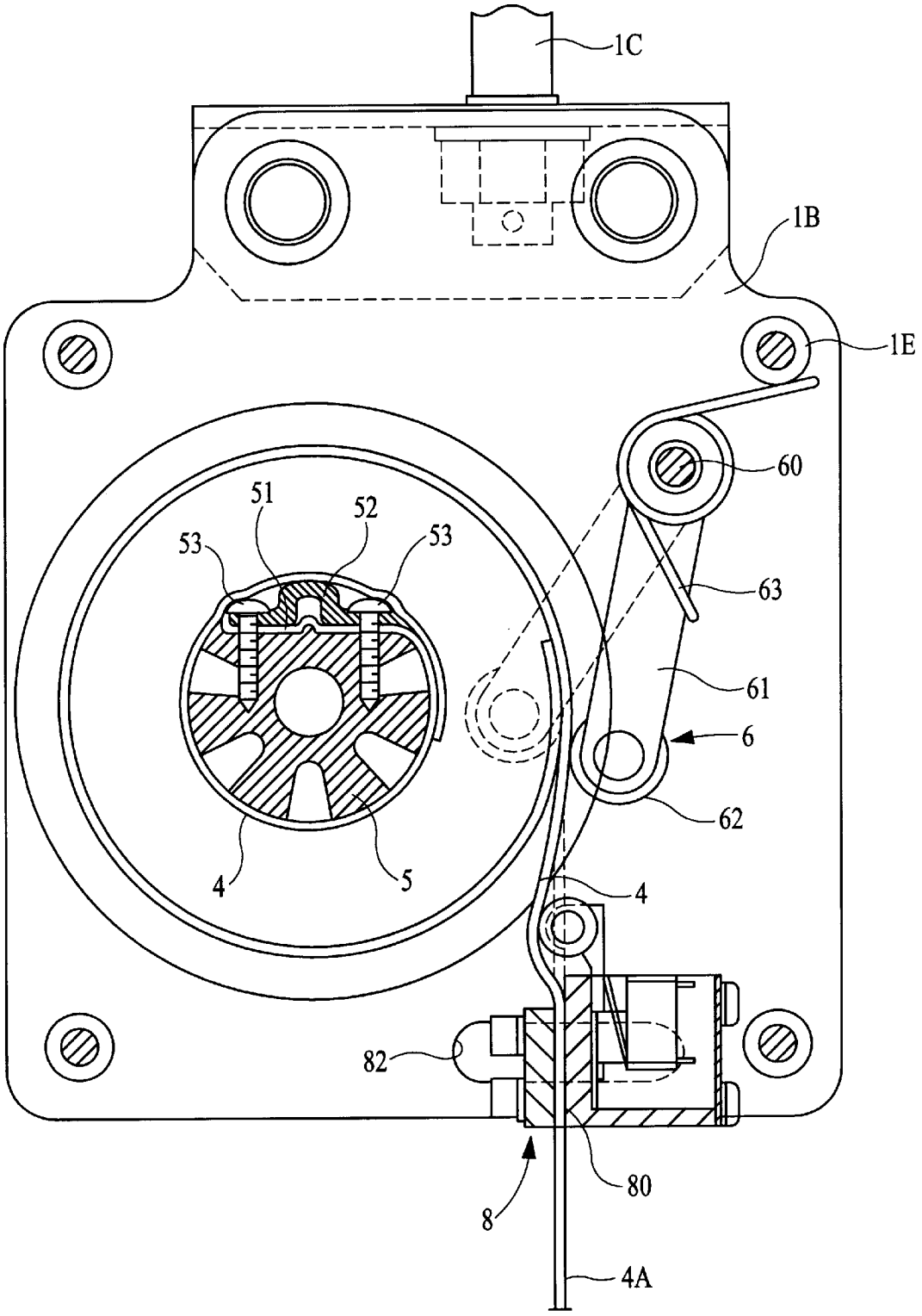
FIG. 1 is a vertically sectioned, side view of the belt hoist according to the invention.
Figure 2:
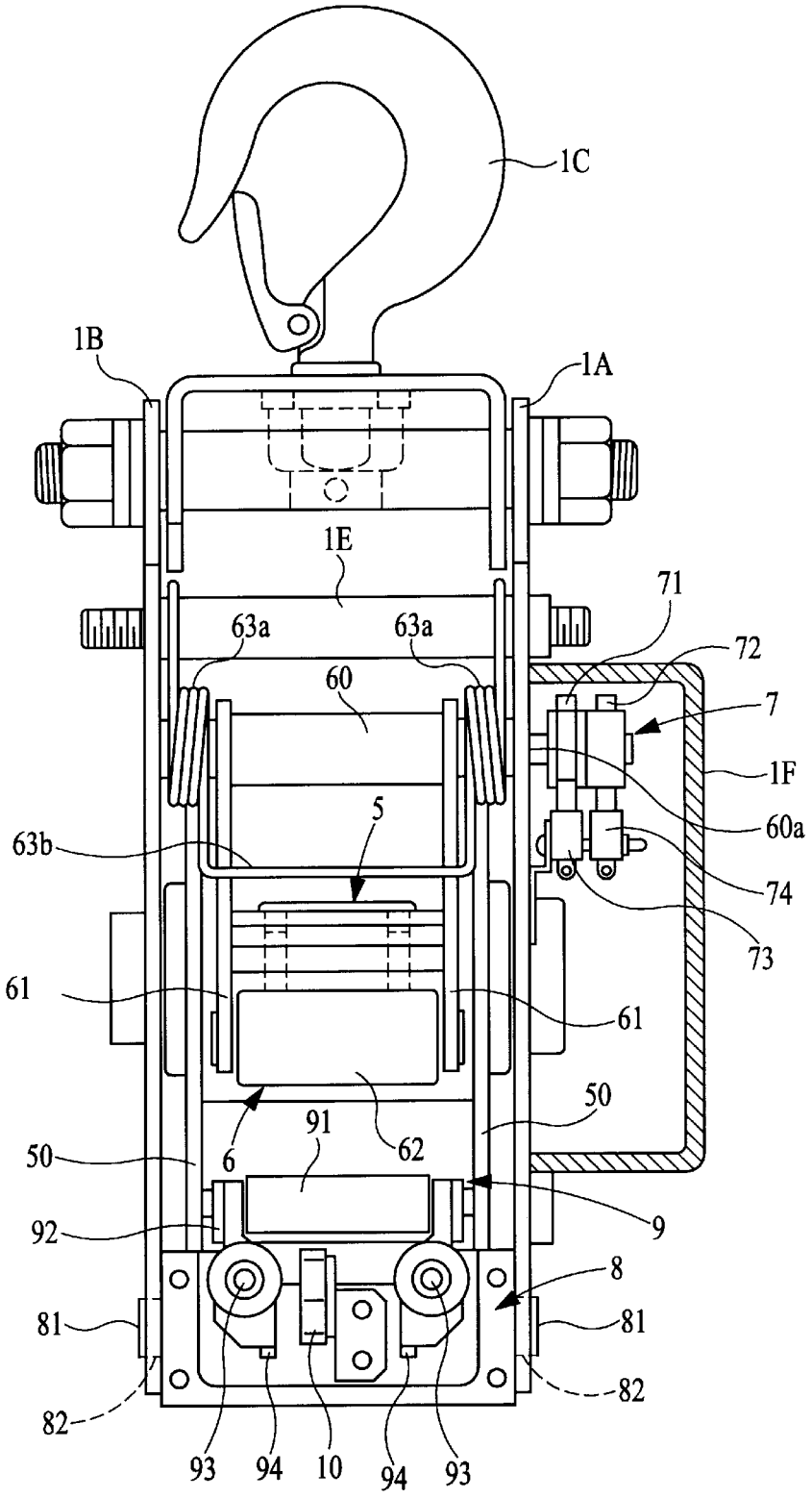
FIG. 2 is a partly cutaway rear view of the same.

As shown in the embodiment of FIGS. 1 and 2, the abovesaid belt hoist includes a random coil preventing member 6, swingably supported on a pivot 60 between the first and second side plates 1A, 1B at a radially outward position of the winding member 5, for normally pressing the belt 4 against the periphery of the winding member 5 to prevent random coil of the belt 4; and a control means 7 for controlling the drive of the motor 2 by swinging motion of the random coil preventing member 6 in response to changes in the diameter of the belt 4 wound around the winding member 5.

The random coil preventing member 6 comprises a pair of spaced apart, opposite arms 61, 61 which are mounted on the pivot 60 rotatably supported between the first and second side plates 1A, 1B; a rotary element 62 in the form of a roller which is rotatably supported to the arms 61 at the front end portion thereof via bearing means and is contactable with the belt 4; and a biasing spring 63 for biasing the arms 61 to the outer periphery of the winding member 5 so that the rotary element 62 can be always pressed against the belt 4. In the FIG. 1 embodiment, the biasing spring 63 is in the form of a coiled spring having a coiled portion 63*a* and spring legs 63*b* extending tangentially from both ends of the coiled portion 63*a*. With the spring legs 63*b* rested on the arms 61 and a rod 1E extending between the side plates 1A, 1B, respectively, the rotary element 62 is always pressed against the belt 4 wound around the winding member 5 through the arms 61.

Figure 3:
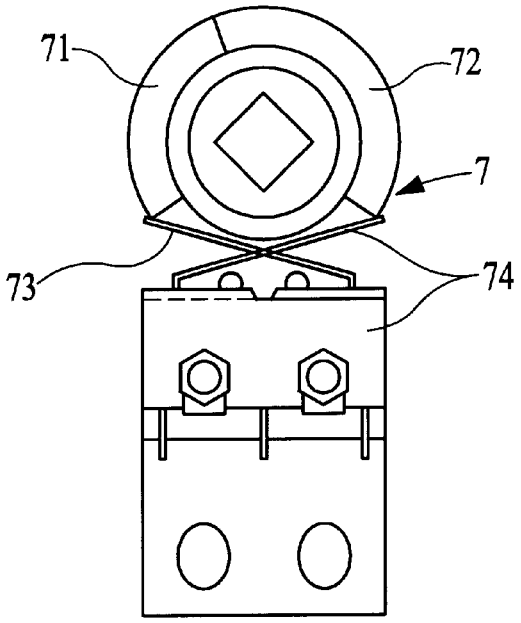
FIG. 3 is a front view of part of a detection switch.
Figure 4:
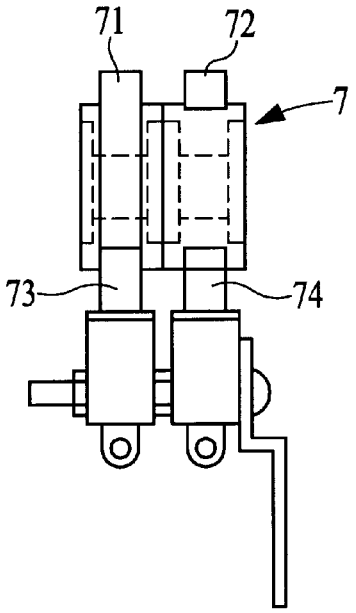
FIG. 4 is a side view of FIG. 3.

The control means 7 is arranged in the following way, as shown in FIGS. 2, 3 and 4. One lengthwise end portion 60*a* of the pivot 60 is projected outward from the side plate 1A. First and second protrusions 71, 72, each being formed by protruding one radial end portion of a boss having a fitting bore outward in generally semicircle, are arranged on the projected end portion 60*a* with a specified phase difference in the circumferential direction and are secured thereto with screws so as to be changeable in position. At positions near the projected end portion 60*a* at the side plate 1A and on swinging paths along which the first and second protrusion 71, 72 movable in response to the turning of the pivot 60 are swung, first and second detection switches 73, 74 are so arranged as to be adjustable in position, respectively. As depicted in a two-dot chain line in FIG. 1, the first detection switch 73, which is formed by a limit switch and the like, is brought into contact with an edge of the first protrusion 71 to stop the drive of the motor 2 when length of the belt 4 wound around the winding member 5 decreases with the unwinding of the belt 4 and the diameter of the belt 4 decreases below a specified diameter. As depicted in a solid line in the same figure, the second detection switch 74, which is formed by a limit switch and the like, is brought into contact with an edge of the second protrusion 72 to stop the drive of the motor 2 when the length of the belt 4 wound around the winding member 5 increases with the winding of the belt 4 and the diameter of the belt 4 on the winding member 5 increases over a specified diameter. In the illustrated embodiment, at the outside of the side plate 1A, a cover 1F for covering the protrusions 71, 72 and the detection switches 73, 74 is detachably fitted to the side plate 1A with fastening screws.

Next, operation of the random coil preventing member 6 effected by the abovesaid construction will be described below. When the motor 2 drives the winding member 5 to rotate so as to wind up and down the belt 4 wound around the winding member 5, the belt 4 is kept on being pressed by the rotary element 62 of the random coil preventing member 6 on biasing force of the coiled spring 63, so that although the diameter of the belt 4 on the winding member 5 varies as the belt 4 is wound up and down, the rotary element 62 is moved toward the belt 4 in response to the variation in the belt diameter. Thus, the belt 4 is prevented from being twisted by the rotary element 62 no matter what diameter of the wound belt is, and thereby the belt 4 can be wound on the winding member 5 in a proper posture at all times without being twisted.

As depicted in a two-dot chain line in FIG. 1, when length of the belt 4 wound around the winding member 5 decreases with the lowering of the belt 4 and diameter of the belt 4 decreases below a specified diameter, the rotary element 62 is moved inward by the coiled spring 63 in response to the decreasing diameter, to drive the pivot 60 to rotate via the arms 61. With the rotation of the pivot 60, the first protrusion 71 mounted on the pivot 60 actuates the first detection switch 73 to stop the drive of the motor 2. On the other hand, as depicted in a solid line in the same figure, when the length of the belt 4 wound around the winding member 5 increases with the winding of the belt 4 and the diameter of the wound belt 4 around the winding member 5 increases over a specified diameter, the rotary element 62 is moved outward in response to the increasing diameter to drive the pivot 60 to rotate. With the rotation of the pivot 60, the second protrusion 72 mounted on the pivot 60 actuates the second detection switch 74 to stop the drive of the motor 2. The motor 2 is kept on being driven to wind or unwind the belt 4 until the protrusions 71, 72 are brought into contact with the related detection switches 73, 74.

As mentioned above, since the drive of the motor 2 is stopped via the protrusions 71, 71 and the detection switches 73, 74 when the diameter of the wound belt 4 increases over or decreases below a specified diameter, both of the over-winding and the over-unwinding of the belt 4 and the resulting breakage of the components of the hoist can be prevented. Besides, since the prevention of the overwinding and over-unwinding of the belt 4 is effected through the use of the random coil preventing member 6 whose movement drives the protrusions 71, 72 to actuate the detection switches 73, 74 to control the drive of the motor 2, reduction in parts count and simplification in structure can be achieved.

Moreover, with the arrangement in which the first and second protrusions 71, 72 are fixed to the projected end portion 60*a* of the pivot 60 which is projected outward from the side plate 1A and the detection switches 73, 74 to be actuated by means of the protrusions 71, 72 are arranged at positions close to the projected end portion 60*a* at the outside of the side plate 1A, any of the protrusions and switches are not an obstruct to the swinging motion of the random coil preventing member 6. Also, such an arrangement has no bad effect on the winding and unwinding of the belt 4 on and from the winding member 5 with which the random coil preventing member 6 is always contacted. Thus, both of the winding and unwinding of the belt 4 on and from the winding member 5 and the random coil prevention of the belt 4 effected by the random coil preventing member 6 can be well accomplished. In addition to this, the arrangement can also provide the advantage that maintenance of the detection switches 73, 74 can be easily made without affecting on the random coil preventing member 6 and the winding and unwinding of the belt 4. Further, the combination of the protrusions 71, 72 with the detection switches 73, 74 enables the controlling means 7 to be simplified in structure and also ensures the controlling of drive of the motor 2.

Further, in the FIG. 1 embodiment, a recess 51 is formed on a part of the periphery of the winding member 5 and an end portion of the belt 4 to be fixed is fixed in the recess 51 via a belt holder 52 and fastening screws 53.

In the aforesaid embodiment in which there are provided the first and second protrusions 71, 72 and the first and second detection switches 73, 74, one of the two protrusions 71, 72 and one of the two detection switches 73, 74 may only be provided by omitting the others.

Further, the random coil preventing member 6 in the aforesaid embodiment may alternatively be provided to be movable in a radial direction of the winding member 5 against a biasing spring, rather than to be swingable, so as to always press the rotary element 62 against the belt 4 wound around the winding member 5.

Further, in the illustrated embodiment, a belt guide 8 having a belt guide portion 80, which allows the belt 4 to be guided to freely pass with being prevented from being twisted, is supported between the side plates 1A, 1B at a position on a moving path along which the belt 4 moves toward or from the winding member 5. The belt guide 8 is arranged so slidably as to allow the belt 4 to be wound onto the winding member 5.

Specifically, as shown in the embodiment of FIGS. 2 and 5–7, the belt guide 8 is provided, at both sides thereof opposite to the side plates 1A, 1B, with engaging projections 81, 81 having a rectangular cross section and extending outward. The side plates 1A, 1B are provided with guide slits 82, 82 in which the engaging projections 81, 81 are slidably inserted and which at least extends within a standard range from an inner position at which the belt of a minimum circle diameter hangs down to an outer position at which the belt of a maximum circle diameter hangs down.

In the illustrated embodiment, each of the guide slits 82 is in the form of an elongate slot which extends horizontally to intersect the belt 4 hung down vertically from the winding member 5. When the belt 4 is wound onto or unwound from the winding member 5, the engaging projections 81 is moved along the elongate slots to drive the belt guide 8 to be horizontally slid in the standard range between the inner position and the outer position, thereby allowing the belt 4 to be wound on or unwound from the winding member 5 with being guided by the belt guide 8.

The guide slits 82 are formed at positions near lower edge portions of the side plates 1A, 1B supporting the winding member 5 at the center portion thereof so that the belt guide 8 can be supported to the guide slits 82 via the engaging projections 81 with its lower edge portion being substantially in alignment with the lower edge portions of the side plates 1A, 1B. With this arrangement, the belt 4 guided by the belt guide portion 80 of the belt guide 8 can be prevented from being brought into direct contact with components of the hoist such as the side plates 1A, 1B to be damaged at the time of winding or unwinding of the belt. In particular, when a heavy load is dragged through the belt 4, the belt 4 is often slanted rightwards or leftwards with respect to a direction for the side plates 1A, 1B to be vertically hung down, but can nevertheless be protected from direct contact with the side plates 1A, 1B to be surely prevented from being damaged.

Figure 5:
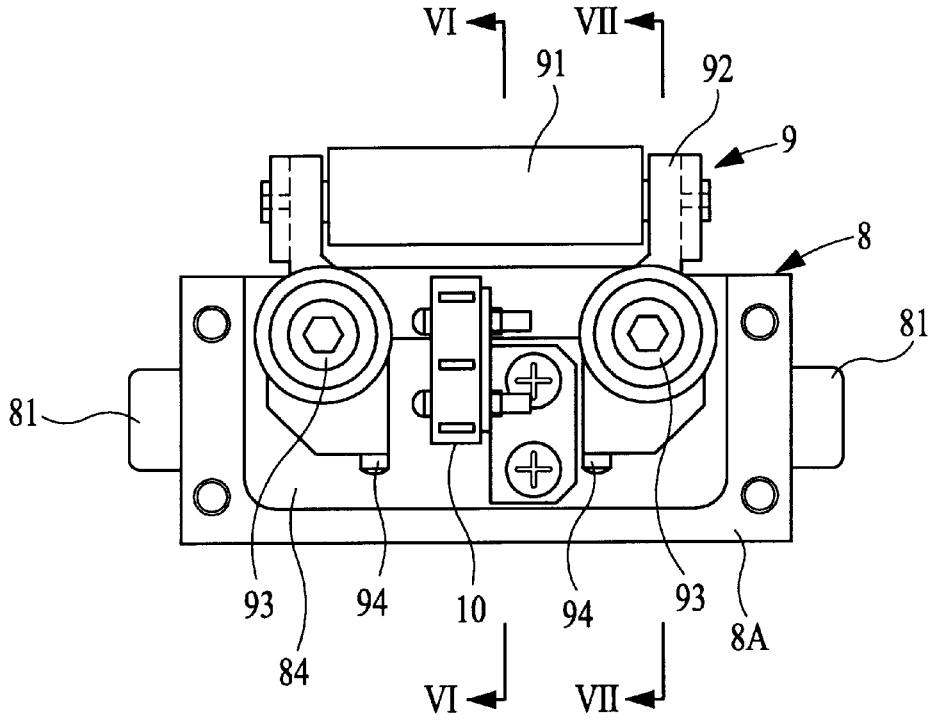
FIG. 5 is a partly omitted front view of a belt guide and a loose belt sensor.
Figure 6:
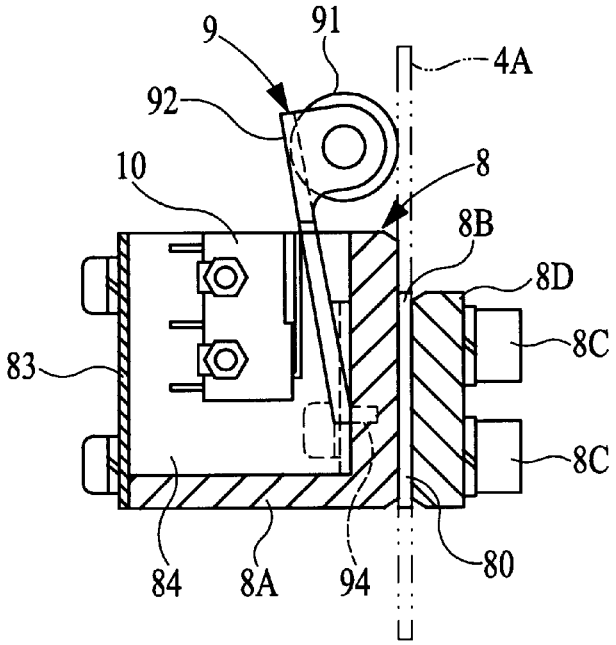
FIG. 6 is a sectional view taken on line VII—VII of FIG. 5.
Figure 7:
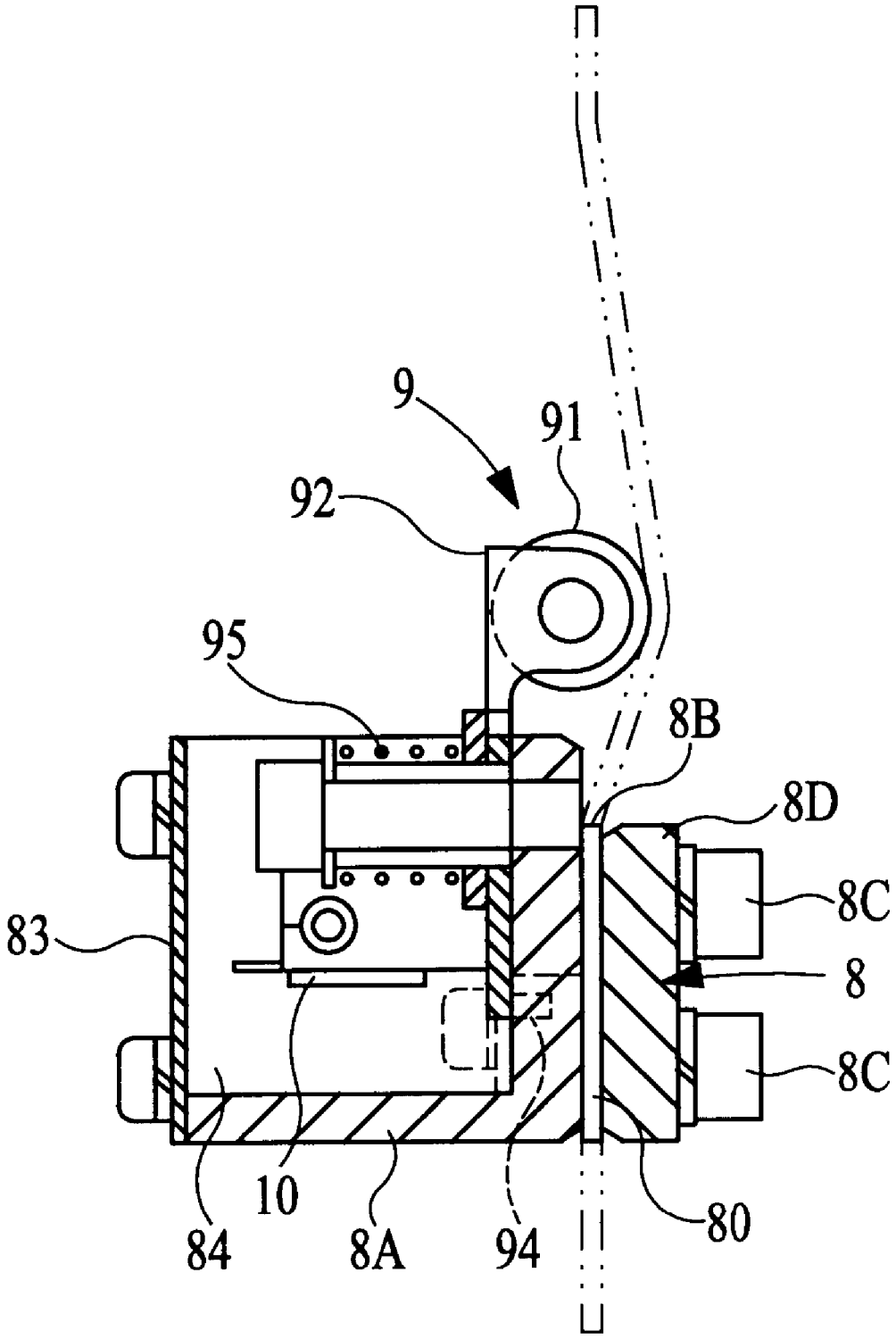
FIG. 7 is a sectional view taken on line VI—VI of FIG. 5.

Further, as shown in FIGS. 5–7, the belt guide 8 is so structured that a guide plate 8D is connected to one side of a body 8A having at its opposite ends the engaging projections 81, 81 by two opposing screws 8C, with a spacer 8B interposed between the guide plate 8D and the one side of the body 8A. The belt guide portion 80 is defined between the guide plate 8D and the body 8A.

The body 8A has an accommodating space 84 closed by a cover plate 83 at its rear surface at the opposite side to the belt guide portion 80. In the accommodating space 84, a belt slack sensor 9 for detecting slack in a portion 4A of the belt 4 to be guided into the belt guide portion 80 and a controller 10 of a limit switch which is turned ON by the action of the belt slack sensor 9 to stop the drive of the motor 2 are secured.

The belt slack sensor 9 comprises a freely rotatable roller 91 which is located on the moving path of the portion 4A of the belt to be guided and is contactable with the portion 4A of the belt which is under tension; and a roller carrier 92 for supporting the roller 91 in such a manner as to freely move within a specified range in a thickness direction of the portion 4A of the belt to be guided. The roller carrier 92 is supported on the body 8A via two opposing horizontal shafts 93, 93 so as to be freely swingable on its hooking portions 94. Between the roller carrier 92 and free ends of the horizontal shafts 93 are interposed elastic members 95 of coiled springs which bias the roller carrier 92 in a direction in which the roller 91 is always contacted with the portion 4A of the belt to be guided.

When the portion 4A of the belt to be guided is under tension as depicted in a chain line in FIGS. 1 and 6, the roller 91 is contacted with the portion 4A of the belt to be guided, and the roller carrier 92 is swung against the elastic member 95, so that the controller 10 is OFF. When the portion 4A of the belt to be guided which is under tension is loosened as depicted in a two-dotted chain line in FIGS. 1 and 7, the roller carrier 92 biased by the elastic member 95 is swung on the hooking portions 94 and is brought into full contact with a rear surface of the body 8A. This brings the controller switching ON to stop the drive of the motor 2 electrically connected to the controller 10.

Thus, the belt 4 inserted into the rectangular hole-like belt guide portion 80 at the belt guide 8 is guided by the belt guide portion 80 at its both widthwise edges so as to be prevented from breakage resulting from its directly contacting with components of the hoist such as the side plates 1A, 1B.

Further, each of the engaging projections 81 is in the form of a square pole whose side is slightly smaller than a breadth of the guide slit 82 so as to be movable along but non-rotatable with respect to the guide slit 82. By the engaging projections 81 slidably inserted in the elongate slots, the belt guide 8 is rendered non-rotatable with respect to the side plates 1A, 1B. This can prevent the undesirable result that the belt guide 8 is rotated to cause the belt 4 to bulge between the belt guide 8 and the winding member 5 when the winding member 5 is rotated in an unwinding direction to pay out the belt 4 with nearly unloaded and a smoothly paying out of the belt can be ensured. It is noted that the engaging projections 81 may be formed into hexagon or non-circular e.g. oval, in addition to rectangular in cross section.

Next, operation of this constructed belt guide 8 will be described below. When wound on or unwound from the winding member 5, the belt 4 is freely passed through the belt guide portion 80 of the belt guide 8. Thus, the belt 4 is wound on or unwound from the winding member 5 with being guided by the belt guide 8 and thus is surely prevented from being taken up in a twisted state or in a randomly coiled state. This enables the belt 4 to be wound on the winding member 5 in a proper posture at all times, so that the belt 4 is prevented from breakage resulting from its being randomly coiled.

Besides, the belt guide 8 is provided at its both sides with the engaging projections 81, 81, and the side plates 1A, 1B are provided with the guide slits 82, 82 which extend horizontally intersecting the belt 4 hanging down vertically from the winding member 5 and in which the engaging projections 81 are inserted. When the belt 4 is wound on or unwound from the winding member 5, the belt guide 8 is horizontally slid in the standard range from its inner position to its outer position in response to changes in circle diameter of the belt 4 around the winding member 5. This constructed belt guide 8 enables twist in the belt 4 to be surely prevented and also allows a smooth winding and unwinding of the belt 4 onto and from the winding member 5.

Here, the guide slits 82 in the FIG. 1 embodiment are each adapted to have a length somewhat larger than the standard range between the inner position and the outer position. This can provide the result that when the belt is slanted in front or in behind with respect to the side plates 1A, 1B by a heavy load dragged, for example, the slope of the belt 4 at the belt guide 8 can be made gentle by moving the belt guide 8 along the guide slits 82 to an extent beyond the standard range. By virtue of this, a dragging work can be done well by use of the belt 4 while the belt 4 is being prevented from being twisted.

Also, when the belt 4 being unwound is loosened at its portion 4A to be guided due to the hook 40 being contacted with the ground or being caught on an obstacle in the course of the unwinding of the belt or any other reason, the roller carrier 92 is swung on the hooking portions 94 and is brought into full contact with the rear surface of the body 8A, bringing the controller 10 switching ON to stop the drive of the motor 2. Thus, the random coil of the belt 4 on the periphery of the winding member resulting from the winding member 5 being rotated in the state that the unwound belt 4 is not under tension can be prevented. Further, the reverse winding of the belt resulting from the winding member 5 being kept on rotating even after the wound belt 4 is paid out entirely can also be prevented.

In the embodiment described above, the guide slits 82 for guiding the engaging projections 81 thereinto are in the form of the elongate slots formed in the side plates 1A, 1B, but need not necessarily be limited to the elongate slots. The guide slits 82 may be in the form of grooves which extend along a sliding direction of the engaging projections 81 and in which the engaging projections 81 are slidable in the specified range mentioned above. In addition, the direction for the guide slits 82 to extend intersecting the belt 4 hanging down vertically from the winding member 5 may not necessarily be limited to the regular horizontal direction. The guide slits 82 may be slightly slanted with respect to the horizontal direction. In short, it is essential that the guide slits 82 are so formed that the belt guide 8 can be slide in response to increase or decrease in circle diameter of the belt 4 wound around the winding member 5 so that the belt 4 can be wound or unwound smoothly and easily without hindering the winding or unwinding of the belt on or from the winding member 5.

Further, in the illustrated embodiment, the engaging projections 81 and the guide slits 82 in which the engaging projections 81 are inserted may be provided at the side plates 1A, 1B and at the belt guide 8, respectively.

Also, instead of the motor 2 used in the above embodiment, a hand-operated lever or chain may be used as the drive means for driving the winding member 5, as in a lever type chain block or a hand chain type chain block.

What is claimed is:

1. A belt hoist comprising:

a winding member around which a belt is wound;

drive means for driving said winding member;

a random coil preventing member pressed against said belt wound around said winding member to prevent a random coil of said belt, said random coil preventing member being movable in response to changes in the wound diameter of said belt; and control means for controlling drive of said drive means in connection with said random coil preventing member when the wound diameter becomes a specified diameter.

2. The belt hoist according to claim 1, wherein said random coil preventing member is so supported to said winding member as to be swingable outwardly with respect to a radial direction of said winding member and is always biased toward an outer periphery of said winding member by a biasing spring.

3. The belt hoist according to claim 2, further comprising (i) a pivot shaft having protrusions provided at an axial end portion of said pivot shaft on which said random coil preventing member is pivotally supported and (ii) detection switches operable by contact with said protrusions when the diameter of said belt over said winding member reaches a specified diameter.

4. The belt hoist according to claim 1, wherein said control means stops the drive of said drive means when the wound diameter of said belt is a specified diameter.

5. A belt hoist comprising:

a winding member around which a belt is wound, said winding member being rotatably supported between two opposing side plates;

a belt guide having a belt guide portion which is arranged between said two side plates in such a freely sliding manner, in response to changes in the wound diameter of said belt, as to allow a winding action of the belt onto said winding member; and a belt slack sensor for detecting slack in a part of the belt to be guided, said belt slack sensor being arranged on a moving path along which part of the belt to be guided into said belt guide portion moves.

6. The belt hoist according to claim 5, wherein one of said belt guide and said side plates is provided with engaging projections and the other of said belt guide and said side plates is provided with guide slits engageable with said engaging projections and extending at least from an inner position at which the belt of a minimum diameter vertically hangs down to an outer position at which the belt of a maximum diameter vertically hangs down.

7. The belt hoist according to claim 6 wherein said engaging projections are shaped into a non-circular form so that said belt guide is non-rotatable relative to said side plates.

* * * * *